United States Patent [19]

Kuse

[11] Patent Number: 4,640,008

[45] Date of Patent: Feb. 3, 1987

[54] APPARATUS FOR COMBINING FASTENER STRINGERS

[75] Inventor: Kazuki Kuse, Toyama, Japan

[73] Assignee: Yoshida Kogyo K. K., Japan

[21] Appl. No.: 721,396

[22] Filed: Apr. 9, 1985

[30] Foreign Application Priority Data

May 10, 1984 [JP] Japan ..... 59-68178[U]

[51] Int. Cl.[4] ..... A41H 37/06; B29D 5/00

[52] U.S. Cl. ..... 29/767; 29/33.2

[58] Field of Search ..... 29/33.2, 408–410, 29/766–770

[56] References Cited

U.S. PATENT DOCUMENTS

| | | | |
|---|---|---|---|
| 2,613,433 | 10/1952 | Rojahn | 29/766 |
| 3,093,893 | 6/1963 | Perrella | 29/766 |
| 4,237,604 | 12/1980 | Sawada et al. | 29/766 |
| 4,238,880 | 12/1980 | Takahashi | 29/766 |
| 4,292,733 | 10/1981 | Iimura | 29/766 |
| 4,392,291 | 7/1983 | Iai | 29/766 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A stringer combining apparatus includes a stringer combining guide section. The guide section has an outer guide member located at the junction of guide groove portions which in combination constitute a Y-shaped guide groove, the member being made resiliently movable in the outward direction, thereby allowing the passage of even members other than fastener elements attached to a stringer. The apparatus further includes a conveyor device for conveying the stringers through the guide section. The guide section is made movable in the direction parallel with the moving direction of the stringers. The guide section is moved by a fluid-pressure cylinder device. Alternatively, the guide section is pressed by the action of a spring toward the downstream side in terms of the conveying direction of the stringers and is maintained at a predetermined operation position by a stopper against the pressing force of the spring and is further made movable against the pressing force of the spring when a force of a predetermined magnitude acts on the guide section toward the upstream side.

1 Claim, 6 Drawing Figures

APPARATUS FOR COMBINING FASTENER STRINGERS

BACKGROUND OF THE INVENTION

1. Field of the Invention

The present invention relates to a combining apparatus for engaging a pair of fastener stringers of continuous length with each other, the fastener stringers having been processed in a state of being separate from each other while being conveyed in their longitudinal directions.

2. Description of the Prior Art:

When fastener stringers are combined together by passing their respective fastener element trains through guide grooves, if members other than fastener elements, such as stops, have already been formed on the stringers, these stops may obstruct the passage of the fastener element trains through the guide grooves. In order to overcome such a disadvantage, a fastener stringer combining apparatus has heretofore been known (such as that disclosed in the specification of Japanese Patent Publication No. 40762/1982; Publication Date: Aug. 30, 1982) in which an outer guide member located at the junction of the guide grooves is made resiliently movable in the outward direction whereby, when the stops are passed, the outer guide member is pushed by the stops in such a manner as to move outwardly, thereby allowing the passage of the stops. In the case of the above-described fastener stringer combining apparatus, however, the guide section inconveniently obstructs the passage of the stops in the backward direction, that is, the direction which is opposite to the above. It is, therefore, not possible to employ such an apparatus when it is necessary to move the stringers in the backward direction in relation to the processing of the stringers. In such a case, consequently, it is disadvantageously necessary to feed the stringers to a subsequent step in a manufacturing process without combining them together.

SUMMARY OF THE INVENTION

In view of the above-described disadvantage of the prior art, it is a primary object of the present invention to provide a stringer combining apparatus which enables stringers to be automatically combined together even in a step in which it is necessary for the stringers to be moved backwardly.

To this end, according to the invention, the guide section as a whole is arranged such as to be movable in the direction parallel with the moving direction of the stringers, whereby stringer portions on the downstream side of the guide section are able to move in the direction which is opposite to the conveying direction of the stringers.

By virtue of the above-described arrangement, the present invention makes it possible for the stringers to move backwardly irrespective of the existence of members other than the fastener elements, such as stops. It becomes, therefore, possible for the stringers to be automatically combined together even in a process in which they need such a backward movement.

The above and other objects, features and advantages of the present invention will become clear from the following description of the preferred embodiments thereof, taken in conjunction with the accompanying drawings.

DESCRIPTION OF THE PREFERRED EMBODIMENTS

The stringer combining apparatus according to the present invention will be described hereinunder in connection with one embodiment in which the invention is applied to a system for manufacturing a slide fastener with a separable end stop in which upper stops and pins which constitute a separable end stop are attached to fastener stringers of continuous length.

Figure 1:
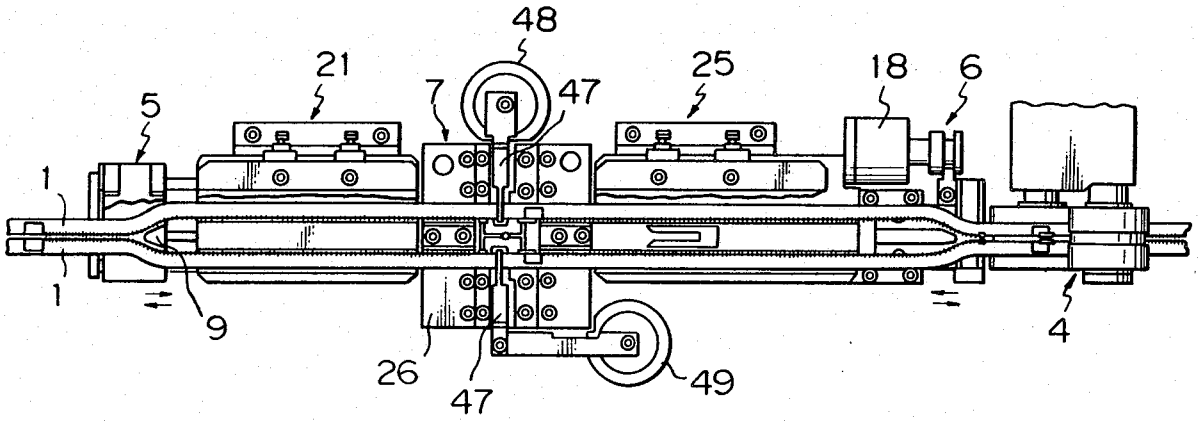
FIG. 1 is a top plan view of a fastener manufacturing system which employs the stringer combining apparatus according to the present invention.

Referring first to FIG. 1 which is a top plan view of a fastener manufacturing system which employs the stringer combining apparatus according to the present invention, in which a part of the system is cut away for explanatory convenience, a pair of stringers 1 are fed from a roll-shaped supply source (not shown) through a pair of guide rollers 2 and a tension roller 3 (see FIG. 2) in a state wherein the stringers 1 are combined together by the engagement between their respective fastener element trains 14. The stringers 1 are intermittently advanced by two rollers which in combination constitute a conveyor device 4.

Figure 3:
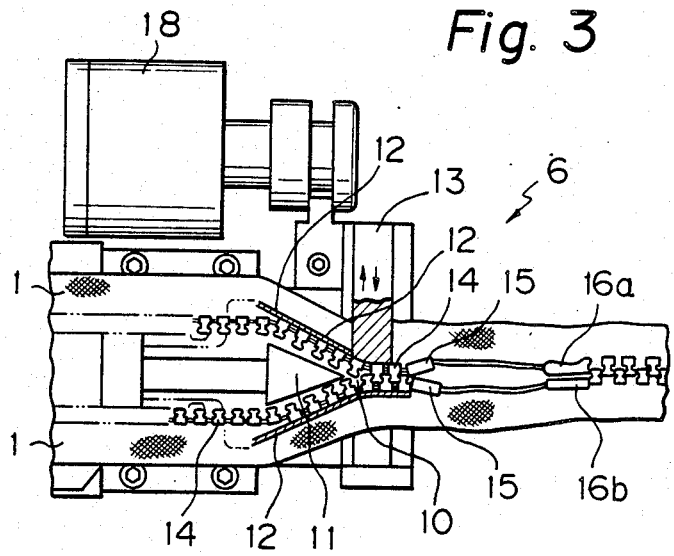
FIG. 3 is a top plan view of a stringer combining guide section in one embodiment of the apparatus according to the present invention.

The fastener manufacturing system has a stringer separating device 5 on the upstream side and a stringer combining guide section 6 on the downstream side. The system further has an injection molding station 7 located between the device 5 and the section 6. The stringer separating device 5 has a wedge member 9 which is disposed in such a manner that the pair of stringers 1, as they are advanced, are split into two by the wedge member 9. Referring now to FIG. 3 which shows the stringer combining guide section 6 in detail, the guide section 6 includes an inner guide member 11, fixed outer guide members 12 and a movable guide member 13. The inner guide member 11 has a tapered distal end, while the fixed outer guide members 12 are disposed in such a manner that they guide the fastener element trains 14 along the tapered distal end of the inner guide member 11. The movable guide member 13 is disposed such as to be in contact with one of the fixed outer guide members 12. These guide members in combination form a Y-shaped guide groove 10 whereby, as the respective fastener element trains 14 of the stringers 1 are passed through the guide groove 10, the fastener element trains 14 are engaged with each other. The movable guide member 13, which is located at the junction of guide groove portions which in combination constitute the Y-shaped guide groove, is pressed by the action of a spring (not shown) toward the fastener element trains 14 in such a manner that they are engaged with each other. The movable guide member 13 is movable upwardly as viewed in FIG. 3 by being pushed by upper stops 15 which are molded in a step, such as that which will be explained later, whereby the movable guide member 13 permits passage of the upper stops 15.

Figure 2:
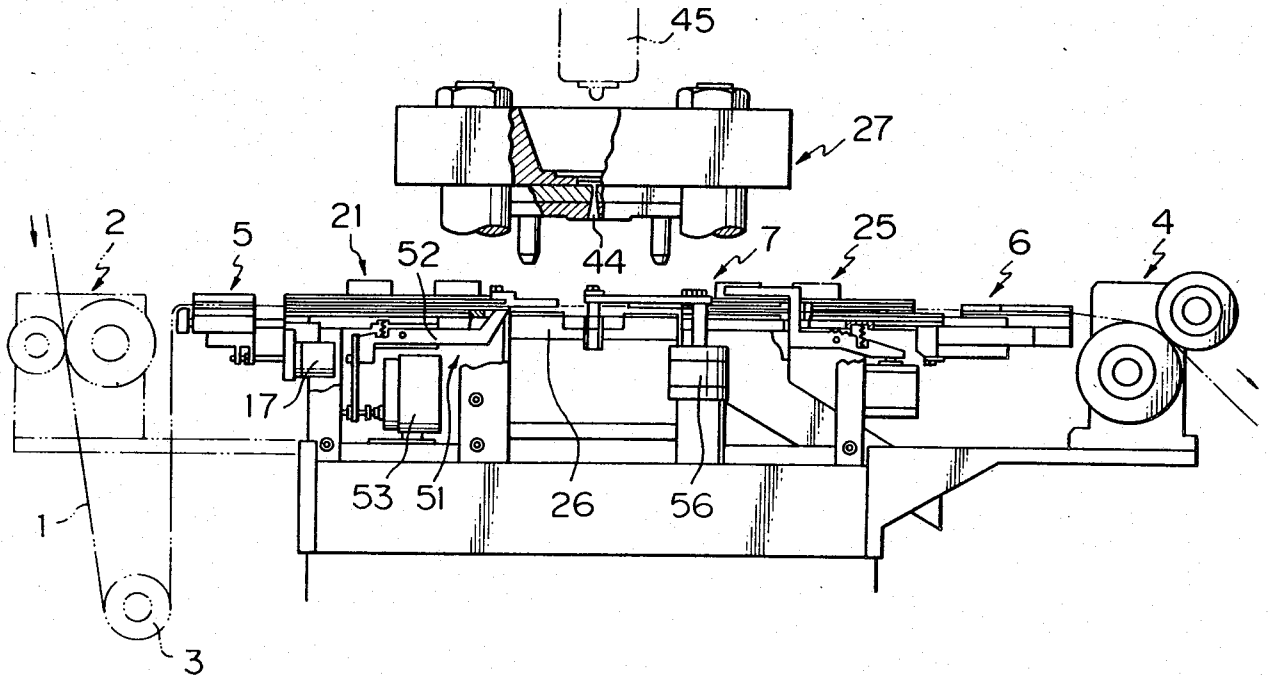
FIG. 2 is a side elevational view of the apparatus shown in FIG. 1.

The stringer separating device 5 is movable in the moving direction of the stringers 1 by the action of an air cylinder 17 (see FIG. 2). The guide section 6 is similarly movable in the direction parallel with the moving direction of the stringers 1 by the action of an air cylinder 18 (see FIG. 1).

A stringer guide device 21 is provided between the stringer separating device 5 and the injection molding station 7. The stringer guide device 21 guides the respective fastener element trains 14 of the stringers 1 which are separate from each other. In addition, the stringer guide device 21 is vertically movable such as to selectively take an upper conveying position and a lower injection molding position. At the lower position, the stringer guide device 21 presses the stringers 1 against a lower die 26 in the injection molding station 7. A stringer guide device 25 is similarly provided between the injection molding station 7 and the stringer combining guide section 6. The stringer guide device 25 guides the resepctive fastener element trains 14 of the stringers 1 which are separate from each other and is vertically movable such as to operate in a manner similar to that of the stringer guide device 21.

Figure 4:
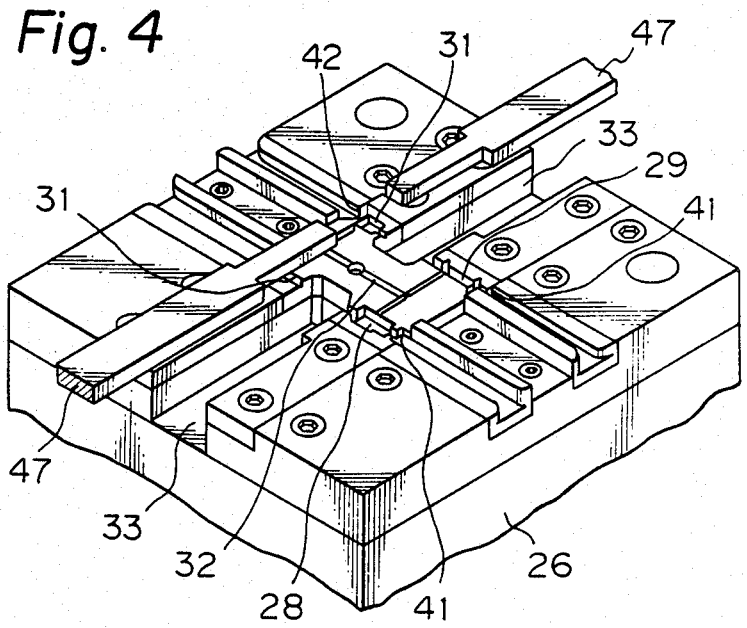
FIG. 4,is a persepective view of a lower die in an injection molding station in the system shown in FIG. 1.

The injection molding station 7 includes the stationary lower die 26 and a vertically movable upper die 27. As shown in FIG. 4 in detail, the lower die 26 has cavities 28, 29, 31 and a runner 32. The cavities 28, 29 are provided for respectively forming pins **16*a*, 16*b* which constitute a separable end stop, while the cavities 31 are provided for respectively forming upper stops 15. On the other hand, the runner 32 supplies a molten resin to these cavities. The lower die 26 is further provided with recesses 33 for respectively receiving stringer bending arms 47, described later. Further, the cavities 28, 29, 31 have stoppers 41, 42 which are formed close to their respective outer ends. The stoppers 41, 42 effect positioning of the stringers 1 in such a manner that, when respective portions of the stringers 1 are bent at a space portion 35 thereof (see FIG. 5) as described later, the stoppers 41, 42 resepctively engage with end fastener elements 36, 37, 38, 39 at opposite ends of the space portion 35 such as to prevent these elements from moving toward the center of the injection molding station 7 and thereby effecting positioning of the stringers 1**.

The upper die 27 is also provided with cavities and a runner for forming the pins and the upper stops in such a manner that the cavities and the runner respectively correspond to those of the lower die 26. The upper die 27 further has a sprue 44 which is formed such as to communicate with its runner. The sprue 44 is communicable with a nozzle 45 of an injection molding machine.

The injection molding station 7 is further provided with the stringer bending arms 47. The arms 47 are respectively connected to air cylinders 48, 49 in such a manner that the arms 47 are vertically movable by the action of the associated air cylinders 48, 49 and can be lowered into the above-described recesses 33, respectively.

As shown in FIG. 2, the guide device 21 is provided at a portion thereof with a space sensor 51. The space sensor 51 includes a sensor lever 52 and a microswitch 53. The sensor lever 52 is biased in such a manner that its distal ends are normally engaged with the fastener element trains 14, respectively, and are able to enter a space portion of the stringers 1 when it approaches them. The microswitch 53 detects displacement of the sensor lever 52 which occurs when it enters a space portion of the stringers 1, and generates a space portion sensing signal when the displacement is sensed.

The following is a description of the operation of the whole of the system for manufacturing a slide fastener with a separable end stop which employs the above-described apparatus according to the present invention.

Figure 5:
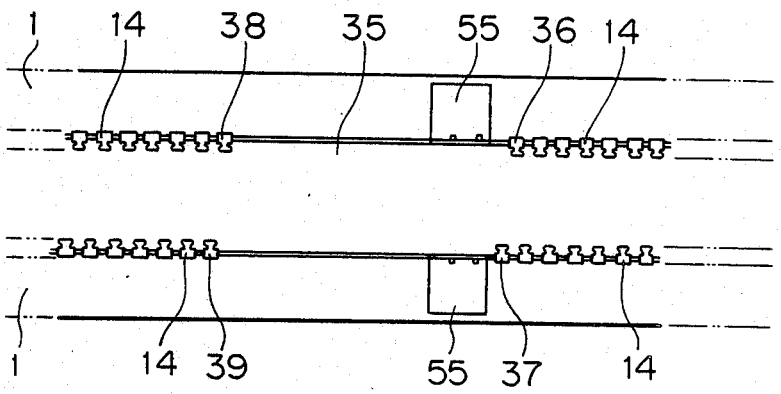
FIG. 5 is a plan view of fastener stringers at a space portion thereof.

The pair of engaged fastener stringers 1 which have been fed through the pair of guide rollers 2 and the tension roller 3 are separated from each other by the wedge member 9, as shown in FIG. 5, and are then fed to the injection molding station 7 while being guided by the stringer guide device 21. In the course of this feeding operation, when the space portion 35, in which there are no fastener elements 14, reaches the space sensor 51, the sensor lever 52 pivots in such a manner as to cause the microswitch 53 to generate a space sensing signal. This signal actuates a timer device or distance measuring device of desired type (not shown) in such a manner that the conveyor device 4 is suspended after a predetermined period of time has elapsed from the time when the space portion 35 has been sensed, or after the stringers 1 have been moved over a predetermined distance. Thus, the space portion 35 is positioned in the center of the injection molding station 7.

Next, the stringer guide devices 21, 25 lower such as to press the stringers 1 against the lower die 26. Each of the rollers constituting the conveyor device 4 is arranged such as to become reversible when it is released from the driving force applied thereto. Accordingly, under this state, the portion of each of the stringers 1 which is on the downstream side of the injection molding station 7 is able to return to the injection molding station 7. Also, the portion of each of the stringers 1 on the upstream side of the injection molding station 7 is able to move toward the injection molding station 7 by the upward movement of the tension roller 3. Then, the air cylinders 17, 18 are actuated such as to move the stringer separating device 5 and the stringer combining guide section 6, respectively, toward the injection molding station 7, whereby it is possible for the stringer 1 to be drawn toward the injection molding station 7.

Next, the air cylinders 48, 49 are actuated such as to lower the arms 47, respectively, thus causing a portion of each of the stringers 1 to be bent independently. By so doing, the stringers 1 are drawn toward the center of the injection molding station 7 until the end fastener elements 36, 37, 38, 39 at opposite ends of the space portion 35 are respectively retained by the associated stoppers 41, 42 of the lower die 26. It is to be noted that the stroke of each of the air cylinders 48, 49 is set to be large enough to ensure that the movement of the stringers 1 is not terminated before the fastener elements 36, 37, 38, 39 are properly retained by the associated stoppers 41, 42, thereby allowing a proper degree of push-down force to act on the arms 47 even after the above-described fastener elements have been retained by the associated stoppers.

Then, the upper die 27 is lowered in such a manner that the upper and lower dies 27, 26 are clamped together, thereby injection-molding pins **16*a*, 16*b*, which constitute a separable end stop, on pieces 55 of reinforcing tape which have previously been attached on the respective stringers 1 by a known method. At the same time, and in a similar manner, upper stops 15 are injection-molding on the respective stringers 1 on the other side of the space portion 35. Thus, the pins and the upper stops are formed by injection molding in a state wherein the positions thereof are accurately regulated relative to the fastener elements positioned in the above-described manner, irrespective of variations in the degree of elongation of the stringers 1 and those in dimension of the space portions 35. Thereafter, the upper die 27 and the guide devices 21, 25 are returned to their previous positions, and the stringer separating device 5 and the stringer combining guide section 6 are also returned to their previous positions. Then, the feeding operation by the conveyor device 4 is resumed. The runner produced at the time of molding the pins and the upper stops is removed by a known method when the stringers 1 are conveyed. After the runner has been removed, the stringers 1 are moved through the guide groove 10 in the stringer combining guide section 6, and while doing so, they are engaged with each other. In this case, the passage of the upper stops 15 is allowed by the outward movement of the movable outer guide member 13**.

The stringers 1 combined together as described above are fed out from the conveyor device 4 and are then equipped with a slider by a known method. The combined stringers 1 are then cut at the space portion 35 and equipped with a box which is secured to one (a box pin) of the pins 16*a*, 16*b*, thus becoming a complete slide fastener with a separable end stop.

As has been described above, the guide section 6 of the stringer combining apparatus according to the present invention is made movable, particularly, in the direction parallel with the moving direction of the stringers 1 by the action of the air cylinder 18. It is, therefore, possible to move the stringers 1 even in a case where the upper stops 15 stop at the stringer discharge side of the guide section 6, as shown in FIG. 3, on accout of the length of the slide fastener to be produced (the length corresponds to a distance between two adjacent space portions of the stringers) and it is not possible for the upper stops 15 to return into the guide section 6 since the upper stops 15 abut against the respective outer ends of the outer guide member 12 and the movable outer guide member 13 of the guide section 6.

Figure 6:
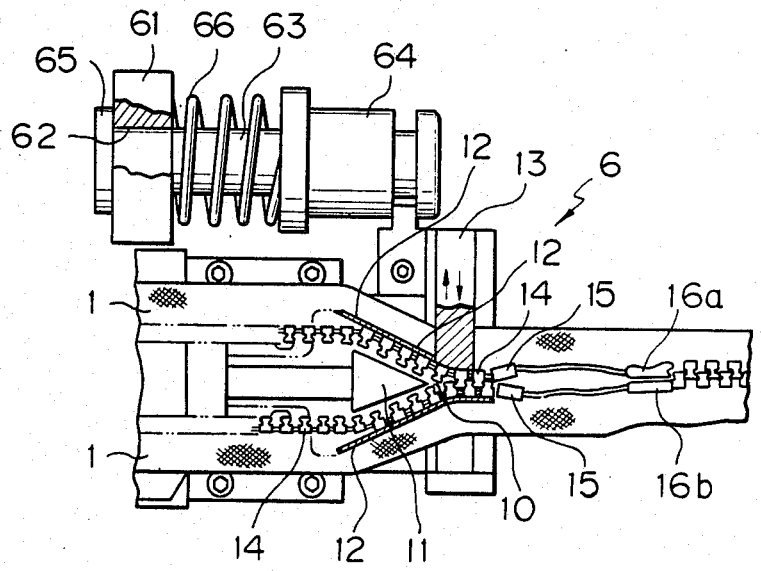
FIG. 6 is a top plan view of a stringer combining guide section in another embodiment of the apparatus according to the present invention.

Referring next to FIG. 6 which shows a stringer combining guide section in another embodiment of the stringer combining apparatus according to the present invention, constituent elements having the same functions as those in the embodiment shown in FIG. 3 are denoted by the same reference numerals, and description thereof is omitted. In accordance with the embodiment shown in FIG. 6, a bracket 61 is secured to the slide fastener manufacturing system. The bracket 61 has a slide bore 62 receiving a slide rod 63 which slides in a direction parallel to the stringer conveying direction. The slide rod 63 is provided at one of its ends with a bracket 64 which is connected to the stringer combining guide section 6. At the other end of the slide rod 63 is provided a stopper 65 which is constituted by a larger-diameter portion of the slide rod 63 for the purpose of preventing the slide rod 63 from coming off the bracket 61. In addition, a compression spring 66 is disposed between the brackets 61 and 64.

In a state wherein the stopper 65 is in contact with the bracket 61 due to the pressing force of the compression spring 66, the guide section 6 is in a normal operation position. In this arrangement, when the fastener stringers 1 are moved backwardly, the upper stops 16 abut against the outer guide members 12 and the movable outer guide member 13, thus applying a force to the guide section 6 toward the upstream side in terms of the stringer conveying direction. When this force exceeds a predetermined value, the guide section 6 is displaced against the force of the spring 66, thereby allowing the stringers 1 to move backwardly.

What is claimed is:

1. In a stringer combining apparatus including a stringer combining guide section having an outer guide member resiliently movable in an outward direction transversely of a stringer, said member being located at the junction of guide groove portions which in combination constitute a Y-shaped guide groove, thereby allowing the passage of members other than fastener elements attached to a stringer, and a conveyor device for conveying a pair of stringers through said guide section, an improvement comprising a fluid-pressure cylinder means connected to said guide section for moving said guide section linearly in the direction parallel with the moving direction of said stringers.

* * * * *